United States Patent [19]

Luke et al.

[11] Patent Number: 4,678,044

[45] Date of Patent: Jul. 7, 1987

[54] TUBING PRESSURE OPERATED INITIATOR FOR PERFORATING IN A WELL BOREHOLE

[75] Inventors: Robert R. Luke, Houston; James M. Barker, Katy, both of Tex.; Michael L. Smith, Sand Springs, Okla.; Larry L. Grigar, East Bernard; Carl B. Miller, Houston, both of Tex.

[73] Assignee: Halliburton Company, Duncan, Okla.

[21] Appl. No.: 846,405

[22] Filed: Mar. 31, 1986

[51] Int. Cl.[4] ..... E21B 43/1185

[52] U.S. Cl. ..... 175/4.52; 175/4.54

[58] Field of Search ..... 175/4.52, 4.54, 4.56; 166/297, 55

[56] References Cited

U.S. PATENT DOCUMENTS

| | | | |
|---|---|---|---|
| 3,064,733 | 11/1962 | Bourne, Jr. | 175/4.54 |
| 3,189,094 | 6/1965 | Hyde | 175/4.52 |
| 3,800,705 | 4/1974 | Tamplen | 175/4.54 X |
| 4,509,604 | 4/1985 | Upchurch | 175/4.52 |
| 4,531,590 | 7/1985 | Peterson | 175/4.52 |
| 4,554,981 | 11/1985 | Davies | 175/4.54 X |

*Primary Examiner*—Stephen J. Novosad
*Assistant Examiner*—Thuy M. Bui
*Attorney, Agent, or Firm*—William J. Beard

[57] ABSTRACT

In a tubing conveyed perforating gun assembly having shaped charges to perforate a well, an improved pressure sequence shaped charge detonator is included. The preferred form of device is appended to the bottom of the assembly to function as a backup detonator. First and second piston and cylinder assemblies in an elongate body provide pressure initiated arming and subsequent pressure initiated firing pin movement to achieve primer cord detonation for perforation of the well. The pressure sequence is controllable, selectively to a specified pressure to arm and thereafter to fire.

22 Claims, 6 Drawing Figures

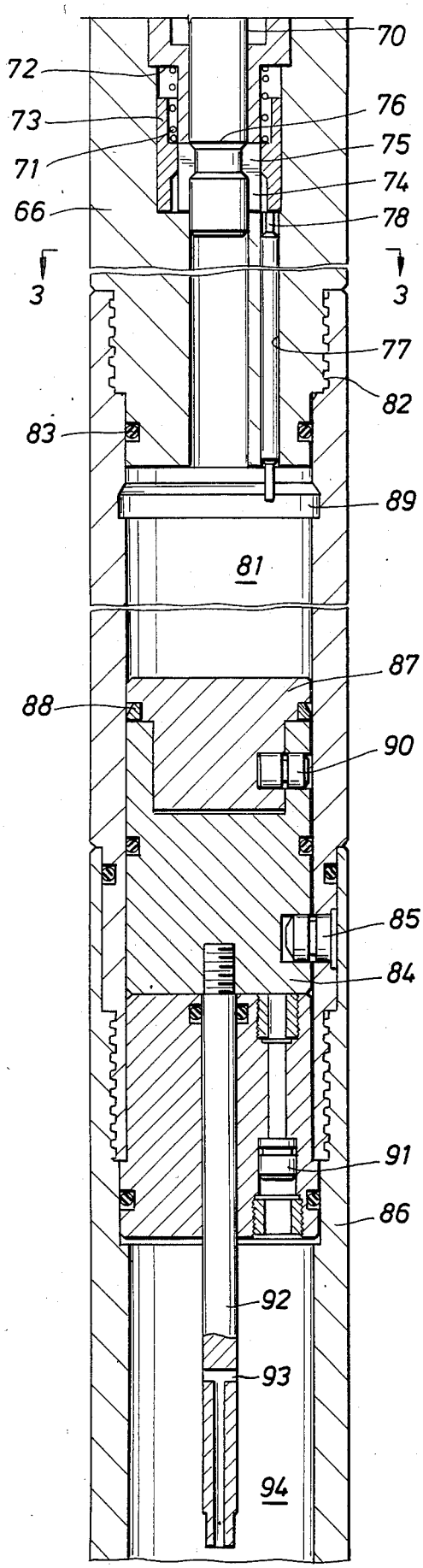
FIG. 2C
FIG. 2D
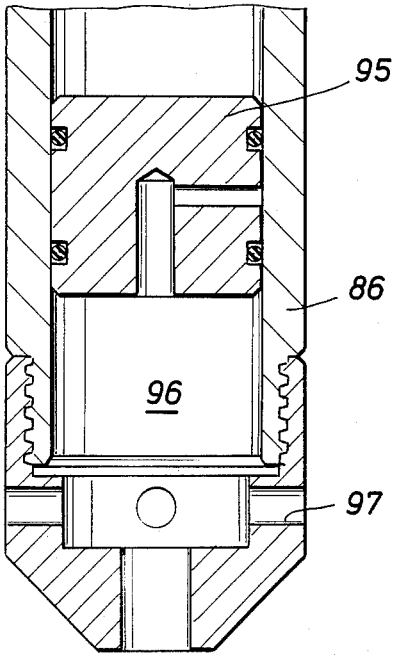
FIG. 3
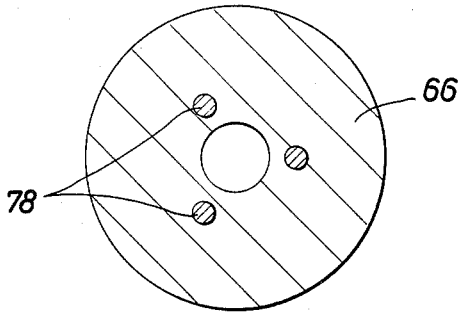

TUBING PRESSURE OPERATED INITIATOR FOR PERFORATING IN A WELL BOREHOLE

BACKGROUND OF THE DISCLOSURE

One of the completion procedures for an oil well is forming perforations into the formation to obtain production from the formation. One technique is to place a string of perforating guns in the borehole adjacent the zone to be produced, detonating the perforating guns to perforate through pipe in the well and into the formation to obtain production. A popular procedure in use of perforating guns is to run them into the well on tubing, this being identified as tubing conveyed perforating (TCP). TCP guns may be detonated by dropping a sinker bar through the tubing which strikes a mechanism at the top of the string of guns. This detonates an axially aligned shaped charge, ignites the primer cord to thereby detonate the perforating shaped charges. There is always the possibility of misfiring from the impact system, and when this occurs, it then requires that the TCP gun assembly be retrieved. This is an extremely dangerous procedure. For instance, great damage can be done to the well should the TCP guns accidentally trigger at the wrong depth. Even more dangerous, it is possible that the shaped charges may detonate above the wellhead during retrieval, sustaining injuries to the operating personnel. For these reasons, it is extremely dangerous to be forced into retrieval of armed TCP guns after malfunction of the firing mechanism.

This is an advance over and includes subject matter of an earlier application, being a continuation-in-part of Ser. No. 737,958 filed on May 28, 1985. The present version sets forth a different pressure operated firing system which serves as a safety or backup system. This and the prior backup system can be triggered through an alternate procedure. Accordingly, it is installed at the lower end of every TCP gun assembly, not used during proper operation of the primary firing mechanism (normally triggered by a dropped sinker bar), and yet is available for emergency use at any time. For safety sake, a backup system is then provided. The backup system operates completely differently than does the sinker bar triggered firing system. Thus, a safe backup procedure, assuming failure of the primary firing system, can be initiated by providing pressure of a specified level through the tubing which supports the TCP guns. A pressure sequence (increase and decrease) is initiated, thereby arming the detonator mechanism and then firing the backup mechanism to set off the TCP guns.

One reference of interest is U.S. Pat. No. 4,509,604 which sets forth a pressure responsive system, in part functioning on pressure in the annulus. Another reference of interest in U.S. Pat. No. 4,484,632 describing an alternate TCP system. As will be described below, the present apparatus utilizes a tubing pressure differential sequence to trigger detonation of the backup system. With the foregoing problem and need in view, the present apparatus is thus briefly summarized as a backup detonation system for TCP guns, the system responsive to a pressure sequence conveyed through the tubing string connected to the TCP guns and is particularly adapted for use on failure of the primary firing system. Other advantages and features of the present apparatus and its method of operation will become more readily apparent upon consideration of the written specification and the drawings which are described below.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIGS. 2*a* through 2*d* is a sectional view through the tubing pressure operated initiator of the present disclosure showing details of construction; and FIG. 3 is a sectional view along the line 3—3.

DETAILED DESCRIPTION OF THE PREFERRED EMBODIMENT

Figure 1:
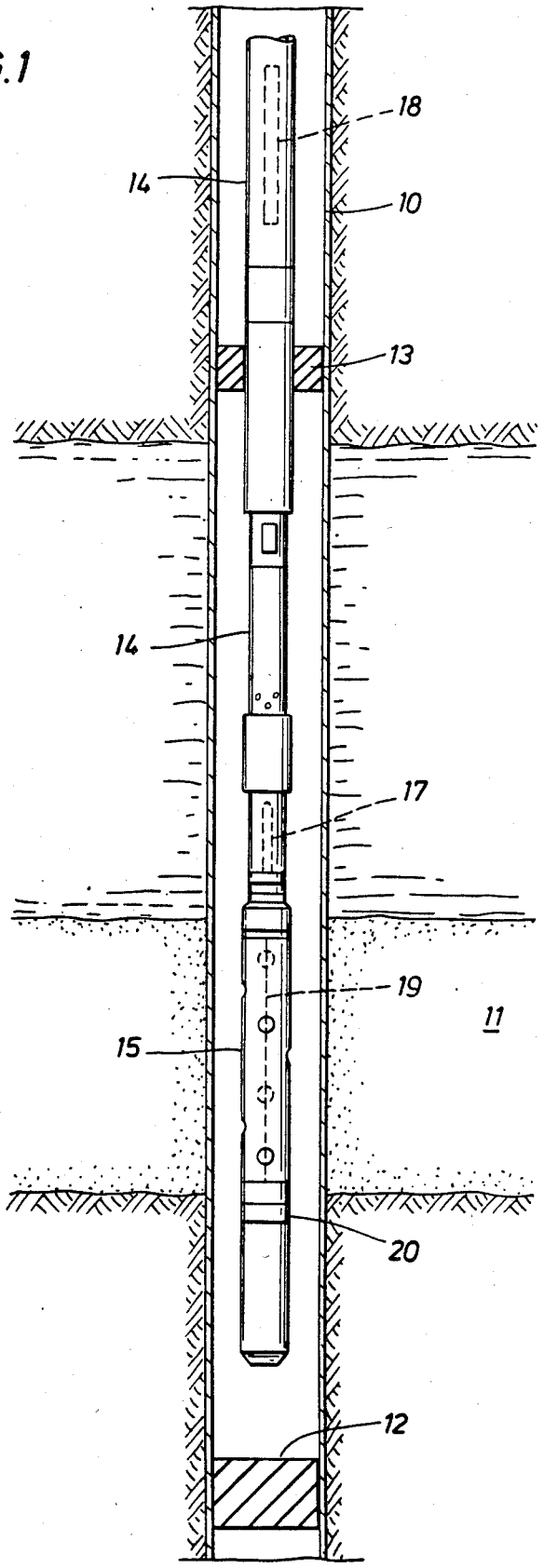
FIG. 1 is a view of a TCP gun assembly supported below a packer and incorporating the backup pressure operated initiator of the present disclosure for firing the guns.

Attention is first directed to FIG. 1 of the drawings. There, a casing 10 is cemented in a well borehole. It passes through a strata or formation 11 which will be perforated. That is, the casing 10 will be perforated, the perforations extending into the formation 11 such that the formation will produce into the well. The casing 10 is customarily cemented in place and the perforations must therefore pass through the casing and the cement on the exterior to open passages into the formation 11 to produce the formation. As a preparatory step, a bridge plug 12 is positioned at a suitable depth below the formation 11 to close off the casing. A packer 13 is set above the formation 11. The packer 13 will be subsequently used to register the equipment as will be described, and seals to enable isolation of the zone between the plug 12 and the packer 13. In this area, the pressure is ultimately controlled prior to detonation of the shaped charges.

The numeral 14 identifies a tubing string. It supports a TCP gun assembly generally indicated at 15. The TCP gun assembly 15 includes a firing mechanism identified in dotted line at 17. It is normally triggered or fired when struck by a sinker bar shown in dotted line 18. Alternatively an annulus pressure operated system such as that shown in U.S. Pat. No. 4,509,604 could be used if desired. The present invention can be used as a backup firing system in either case. In a sinker bar activated primary firing system, the sinker bar strikes the firing mechanism with sufficient force to initiate firing, the detonation being conducted to the various perforating shaped charges by means of a primer cord in dotted line 19. The primer cord extends from the firing mechanism 17 to operatively connect to the many perforating shaped charges. The number of shaped charges is varied, potentially several hundred shaped charges to perforate over a selected length of casing and adjacent zone.

Figure 2A:
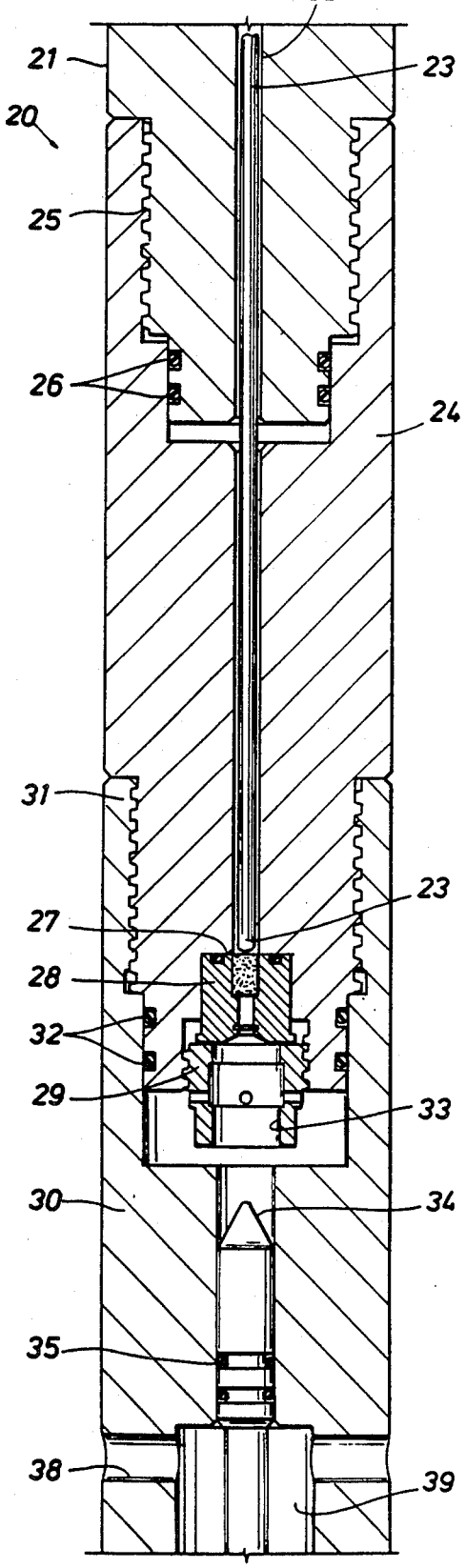
Figure 2B:
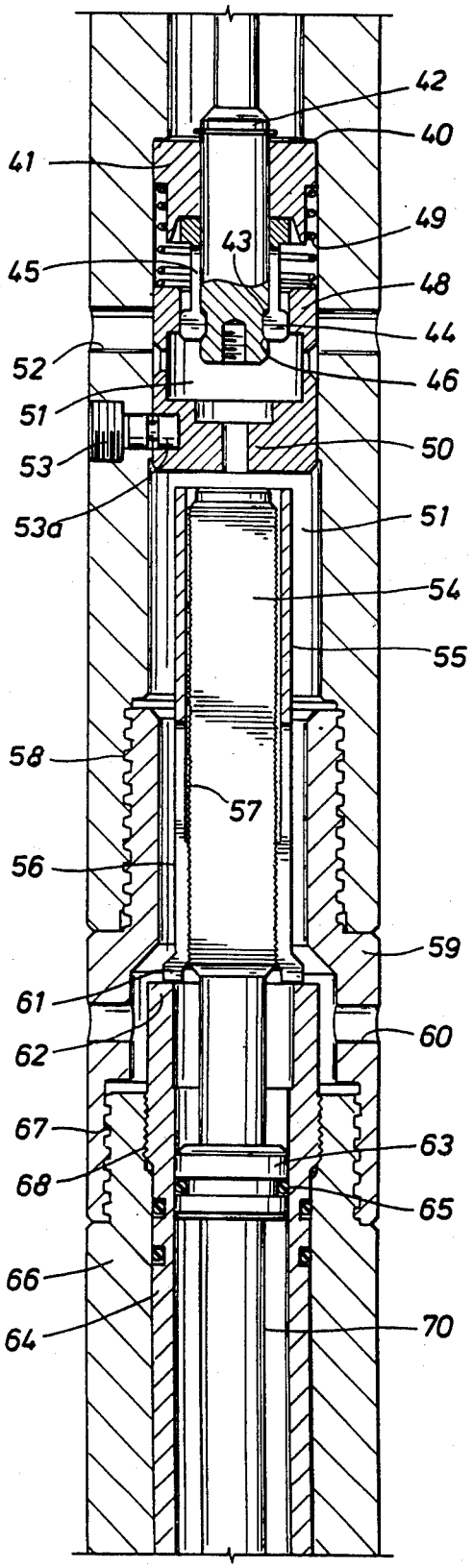

The bottom end of the TCP assembly 15 supports the tubing pressure operated firing initiator 20 of the present invention. In the event of malfunction of the first detonator assembly 17, the backup system 20 is then used. The remoteness of the backup system isolates it from damage that might arise on partial detonation. Moreover, the firing assembly 20 is also remote from and independent of operation of the sinker bar 18 in the event the sinker bar snags or does not otherwise reach the bottom of the tubing 14. The backup firing mechanism is an alternate structure which is conveniently threaded to the lower end of the TCP gun assembly 15 which will be described in greater detail on reference to FIG. 2 of the drawings.

In FIG. 2 of the drawings, the numeral 21 identifies a subassembly which has a threaded connection with the TCP assembly 15. Thus, the entire backup initiator assembly 20 suspends below the bottom-most gun and is spaced sufficiently therefrom that it is able to operate without apprehension that misfiring of any of the equipment above will prevent safe and certain operation. The sub 21 is hollow, having an internal passage 22. The passage 22 extends upwardly to the assembly 15 above, enclosing a primer cord 23 which extends along the passage.

The sub 21 is threaded to a suitable housing 24 by threads 25, and a suitable seal is perfected by seals at 26. The housing 24 also is provided with a passage through the center, enabling the primer cord 23 to extend through it in the same fashion. The housing 24 has an enlarged central opening at 27 to receive a primer assembly 28. The primer assembly is seated adjacent to the lower end of the primer cord 23. They are placed adjacent to one another to assure that the explosive in the primer assembly 28 initiates detonation of the primer cord. The primer 28 is a cylindrical assembly which is held in the housing 24 by means of a hollow threaded bolt 29. The bolt 29 threads to the lower end of the housing 24 to lock the primer 28 in location.

The entire mechanism 20 disassembles near the primer 28 (below the housing 24) to enable it to be replaced after using. To this end, there is a firing pin housing 30 which is below the housing 24. The housings thread together at a threaded connection 31. Joinder of the two housings forms a closed, sealed chamber, therebeing seals 32 between the two housings to assure isolation of the chamber for the primer 28. The bolt 29 is axially hollow at 33 to receive a pointed firing pin 34 impacting against the primer 28. The firing pin travels axially through a passage in the firing pin housing 30. The firing pin 34 has a tip which is shaped to strike and initiate detonation from the force of a blow on the primer 28. The firing pin has an elongate shaft sized to fit within the passage 33 after moving along the firing pin housing 30. The firing pin housing 30 is sealed relative to the firing pin 34 by means of a seal ring at 35. Thus, the area near the primer 28 is isolated from pressure on the exterior of the tool. This prevents building up an air cushion above the firing pin so that the primer 28 is in a chamber at ambient pressure to aid later firing.

Proceeding down the tool body, the firing pin housing is perforated at 38 to deliver external pressure into an annular chamber 39. The chamber 39 (around the firing pin) therefore sustains the same pressure which is on the exterior of the initiator 20. The firing pin housing 30 has an internal shoulder at 40 which supports a collet spring retainer 41. The retainer 41 fits around the firing pin. The firing pin 34 has an enlarged portion at 42. The enlargement 42 is notched with an external groove at 43. The shoulder 43 catches against enlargements 44 on a set of collets 45. The collets are received against the collet retainer 41 abutting the shoulder 40. The enlargement 44 locks the firing pin 34 against upward movement. This locking position prevents movement of the firing pin until the collets are released. Collet release requires radial outward expansion of the collets 45. In particular, this is achieved by moving the enlargement 44 radially outwardly from the groove 43 to thereby disengage the groove 43 previously securing the firing pin against movement. This operation is controlled by a collet latch sleeve 48. In the illustrated position, the collet latch sleeve 48 is held in a latching position by means of a collet spring 49. The spring 49 bears against the collet spring retainer 41. When the spring is sufficiently compressed, the enlargement 44 rides over the shoulder of the groove 43 and expands toward the collet latch retainer sleeve 48. Thus, radial outward movement of the collet assembly is forbidden until the spring 49 is compressed by upward movement of the retainer sleeve 48.

This sequence of operation does not occur until upward movement of a shear pin piston 50 occurs. The shear pin piston 50 is received in a chamber 51 on the interior of the housing 30. The shear pin must be broken to enable the piston to move up to compress the spring 49. Once the spring 49 is compressed, the collet assembly is then released to enable upward movement of the firing pin. Upward movement may require venting of the chamber 51, and to this end, a port 52 to the exterior relieves pressure buildup around the piston 50. The piston 50 is axially hollow so that the chamber 51 is not pressure isolated either above or below the piston 50. The piston 50 is integral with the retainer ring 48. The ring includes a cylindrical skirt with suitable holes to communicate with the port 52 and hence the exterior of the tool. The piston 50 is not free to move because a screw supported shear pin 53 prevents movement. This shear pin locks the piston 50 in place until the shear pin is broken. After the pin has been broken, it can be conveniently replaced on removal of the screw during servicing.

As described to this point, the piston 50 moves only after shearing the pin. Moreover, such movement also releases the collet latch mechanism that holds the firing pin in place. This is accomplished by compressing the spring 49 and enabling the enlargement 44 on the collets to deflect radially outwardly, unlatching the firing pin. Hydrostatic pressure drives the firing pin to strike the primer 28 previously described. When the primer 28 is struck, it detonates the primer cord 23 and thereby initiates detonation of the shaped charges carried in the assembly 15 above.

In the chamber 51, an actuator rod 54 is positioned just below the piston 50. The rod 54 controllably strokes the piston 50 with a force sufficient to shear the pin 53. This movement is controlled by the apparatus below the actuator rod 54. The actuator rod as originally installed (for running in the well) is not free to travel. A ratchet sleeve 55 fits around the rod 54. The sleeve 55 is slotted for a portion of its length to define a set of flexible collet fingers 56. The collet fingers extend along the actuator rod 54 and thread to it on the exterior surface. This threaded connection is illustrated at 57. The threads are cut so that the collet fingers will thread to the actuator rod 54 when they are in their unflexed position. Thus, the two members are threaded together and assume the position shown in FIG. 2*b* of the drawings by threaded engagement. The sleeve 55 remains stationary while the rod 54 moves relatively downwardly with a ratcheting movement. This requires that the thread between the actuator rod 54 and the collet fingers 56 incorporate a buttress thread enabling the collet fingers to ride over, flexing radially outwardly and relaxing as they ride over the crown of the threads on the actuator rod. That is to say, ratcheting movement permits the actuator rod to move relatively downwardly and yet locks the two members together so that relative upward movement of actuator rod is forbidden. So to speak, this ratcheting interaction extends the length of the actuator rod. The arming sequence of the device utilizes this feature namely, arming by pulling the actuator rod 54 downwardly, ratcheting the sleeve as downward movement occurs and locking the two members together for later movement upwardly as a unit. Disassembly of the tool is permitted so that the sleeve 55 can be threaded by hand for resetting. To this end, the housing 30 terminates at a thread 58 which in turn enables connection with a short threaded sub 59. The sub 59 is perforated at 60 to introduce well pressure to the region near the actuator rod 54.

The collet fingers 56 support an enlargement 61 at the lower end of the fingers. This enlargement faces an abutting threading member 62 that will be described. This locks the enlargement 61 against downward motion, initiating the ratcheting movement which permits the actuator rod 54 to move downwardly. The actuator rod 54 is later driven upwardly by an actuator piston 63. The piston 63 is pressure driven in a manner to be described. It is received within a surrounding cylinder 64, and has a cooperative seal 65. The cylinder 64 is a liner placed inside of a surrounding housing 66. The housing 66 threads to the sub 59 at a threaded connection 67. Moreover, the cylinder 64 is also threaded on the interior of the housing 66 by means of a threaded connection at 68. The piston 63 is equipped with the actuator rod 54 above the piston and also includes a locking rod 70 extending below the piston 63. The cylinder 64 has an external shoulder 71 (near the lower end thereof) which bears against a coil spring 72. The opposite end of the spring 72 bears against a sleeve 73 to force the sleeve 73 downwardly. In the downward position, the sleeve holds a set of collets 74 radially inwardly in a locking position. The collets 74 include an enlargement 75 which locks in a conformed groove 76 on the piston lock rod 70. The collets are captured against the inside shoulder of the housing 66. Thus, they cannot move upwardly or downwardly. In the illustrated position, the lock rod 70 is fixed, not free to move. When the sleeve 73 moves upwardly, the collet enlargement 75 is released thereby permitting movement of the rod 70. More will be noted concerning this later.

The housing member 66 is provided with multiple internal, parallel passages at 77, and a push rod 78 is positioned in each passage 77. Typically, two or three push rods will suffice for operation. The movement of the push rods is relatively short. The rods 78 are prevented from falling out of the passage 77 by snap rings. The several rods 78 force the sleeve 73 upwardly, releasing the collet grip on the rod 70 to enable the rod 70 to move after release. In the illustrated position, the rod 70 is temporarily in the down position. The housing 66 is threaded to a lower housing member 80. It defines an internal chamber 81 which is charged with dry nitrogen gas. The members 66 and 80 are joined at a threaded connection 82. Seals are also included at 83 to prevent leakage of the gas charge. At the top end, the chamber 81 exposes the lower ends of the push rods 78. At the opposite or lower end of the chamber the chamber encloses a gas piston 84. The piston 84 travels upwardly in the chamber to contact the push rods 78 to drive them upwardly. When this occurs, the push rods upset the sleeve 73, unlatching the collets and enabling movement of the rod 70 previously mentioned. The gas piston 84 is fixed in location at the lower end of the cylinder temporarily by means of a shear pin 85. The shear pin is received in radial hole in the housing member 80, the member 80 extending therebelow. The member 80 has a step formed on the exterior to receive a threaded bottom cylindrical housing member 86. Suitable seal rings prevent leakage along the shear pin 85. Moreover, the members 80 and 86 are threaded and sealed so that the chamber 81 is protected against leakage.

The piston 84 is held against initial movement by the shear pin 85. It is forced upwardly by oil (an incompressible fluid) from below while compressing gas above in the chamber 81. The piston 84 is made of multiple pistons as will be described. The top end is a separable piston 87. This piston rides on the top and has an undercut groove holding an expandable C ring 88. The ring 88 is compressed to fit into the surrounding chamber 81 so that the two joined pistons can move as a unit toward the upper end of travel. The C ring 88 is compressed originally but expands into a mating inside groove 89 to latch and lock, thereby holding the piston 87 against subsequent movement. The ring 88 locks the piston 87; it does not form a gas seal and permits the gas compressed at the top end of the chamber 81 to act on the piston 84. Noting the pressure can be very high after compression on the upstroke, the piston 84 is exposed to significant pressure loading on the top face by the compressed gas above it.

The piston 87 is joined to the piston 84 by a shear pin 90. The two pistons move upwardly together; they are separated by breaking the shear pin 90. The gas in the upper end of the chamber 81 is compressed to act on the top of the piston 84; the pressure below the piston 84 is dropped (to be explained later) which creates a sufficient force to shear the pin 90 and release the piston 94 for downward movement and return to the original position of the piston 84 illustrated in FIG. 2. However, the piston 87 cannot return because it latches at the upper end of travel, this occurring by locking the C ring 88 into the groove 89.

This locking position of the piston 87 in the up position abuts the rods 77 and forces them up. They are locked in the up position and do not fall away from the up position. When the rods 77 are up, the upper ends force the sleeve 73 upwardly to achieve disengagement of the collets 74. The piston 84 moves upwardly to define a chamber below the piston 84. This chamber is filled with oil introduced through two paths, one being a passage 91. An orifice restrictor is located in the passage 91 to restrict oil flow in both directions through the passage 91.

The piston 84 carries a centered, downwardly extending piston extension rod 92. The rod 92 includes a bypass passage 93. The rod 92 is sufficiently long to permit oil flow into the rod 92 and out through the bypass passage 93. The spacing of the rod length and passage 93 deliver oil below the piston 84 in addition to the oil flowing through the restricted passage 91. Incidentally, the passage 91 can be replicated to obtain a desired flow rate. The bottom cylindrical housing 86 previously mentioned defines an oil chamber 94. This chamber is located below the piston 84. Oil is introduced from the chamber 94 through the restrictor 91 below the piston 84. The chamber 94 is filled through a removable plug port at the lower end of the oil chamber 94. Oil in the chamber 94 is above an oil piston 95. The piston 95 is captured within the housing member 86. The piston 95 is forced upwardly by pressure under the piston 95 received in the chamber 96 within the housing 86. The housing 86 closes at the very bottom end of the tool body. Pressure on the exterior of the total body is introduced through a port or passage 97 opening into the chamber 96 from the exterior of the tool. Movement of the piston 95 is thus dependent on pressure applied below the piston, forcing the piston upwardly. When the piston 95 moves upwardly, oil above the piston 95 is forced under pressure through the restricted passage 91 to move the gas piston 84 upwardly. Oil is also introduced upwardly through the bypass passage 93. This flow path is initially blocked until the passage 93 is ported to deliver oil into the gas chamber 81. In other words, the piston 84 is raised solely by the oil flowing through the restrictor passage 91, this continuing until the bypass passage 93 is unblanked to add more oil below the piston 84 and thereby speed up the movement of the piston 84. The piston 84 travels upwardly slowly for the first portion of its travel and then moves rapidly to slam to the top. This slamming movement is important to locking the separable piston 87 in the up position with the expandable ring 88. The purpose of this will be described later. More will be noted concerning this in review of operation of the device.

Sequence of Operation of the Device

Operation of the firing initiator 20 shown in FIG. 2 can best be understood by tracing one sequence of its operation. The sequence begins at the bottom of the tool subject to initial conditions. The operation results in detonating the primer cord extending lengthwise of the firing initiator means 20 for detonation of the shaped charges.

The initial conditions where operation of this apparatus come into play will be first described. The initial conditions assume that the TCP gun assembly has been landed in the packer 13 and has been sealed at the packer. Moreover, the firing mechanism 17 has been used unsuccessfully, typically by dropping the sinker bar 18 on it. At this juncture, no firing has occurred and the shaped charges are still positioned adjacent to the formation 11. Between the plug 12 and the packer 13, a particular pressure is maintained and will be described as hydrostatic pressure. This is the pressure in this region between the plug 12 and the packer 13. The tubing string 14 is able to conduct fluid flow (gas or liquid) under pressure. The tubing string includes suitable open parts to introduce fluid. Fluid flows into the region around the TCP gun assembly 15 to increase the pressure below the packer 13. Assume that the initial pressure below the packer 13 is substantial, perhaps 500 psi. This defines the hydrostatic pressure in the vicinity of the means 20.

Pumps at the surface introduce a fluid under high pressure through the tubing 14 past the packer 13 and into the regions above the plug 12. The pressure in this area is raised to a specified level which can be controlled from the surface. Assume that hydrostatic pressure is 5000 psi in this region. The pumps are operated until higher pressure is accomplished, and the device of the present invention is armed by this higher pressure. There are certain shear pins which can be selectively changed to require different pressures to operate. More will be noted concerning this hereinafter. For purposes of description, assume that the operating pressure requires 8000 psi while the hydrostatic pressure without aid of pumps is 5000 psi below the packer 13. This requires a boost of 3000 psi for operation of the device. This large change is a safety factor, namely that the firing initiator 20 is not armed until this change in pressure is first achieved and a subsequent pressure drop is also achieved. Accidental firing is thus prevented by properly sizing shear pins utilized in the device.

Assume for the moment then that 8000 psi is required to initiate operation of the device. As pressure rises, the pressure near the tool 20 increases and this pressure is introduced into the chamber 96 at the bottom end of the tool. This compresses hydraulic oil in the oil chamber 94 by means of the piston 95. The oil flows at a limited or restricted rate through the restrictor passage 91. Oil flows upwardly through the passage 91. In the preferred embodiment, the flow rate of the restrictor is adjusted and hence, one or more passages can be used and one or more restrictors can also be used. In any event, at a controllable rate, the pressure below the piston 84 is increased by oil delivery from below. Ultimately, a sufficient pressure increase is achieved to shear the pin 85. As will be understood, the device is constructed so that one or more shear pins positioned around the piston 84 are broken collectively. This is accomplished when the pressure forcing the piston 84 upwardly exceeds a certain level an adequate shearing force is accomplished. When shearing occurs, the piston 84 is free to move upwardly. While it moves upwardly, the piston 84 compresses the gas above the piston 84 in the chamber 81. Assume that the pressure driving the piston 84 is adequate to drive the piston 84 the full length of the chamber 81. When the piston 84 travels to the top of its stroke, it strikes the push rod 78, and is locked in place due to the action of the expandable C-ring 88. Again, in the preferred embodiment, redundant construction utilizes up to about four of the push rods 78. This assures that failure of one push rod does not cause the device to fail in operation. The piston 84 moves upwardly, striking the rod 78, forcing all of the rods 78 upwardly. They force the sleeve 73 upwardly against the spring 72. This moves the sleeve 73 to a location enabling the collets 74 to flex radially outwardly which is accomplished. When this occurs, this frees the rod 70 for movement. At this point of operation, the rod 70 is free to move and hence, the piston 63 has been freed to move.

The piston 63 is exposed to pressure from the exterior of the tool through the port 60. In this example, the pressure of the exterior of the tool is 8000 psi. That acts on the top side of the piston 63 to push the piston 63 downwardly. The piston travels downwardly, pulling the actuator rod 54 with it. When the actuator rod moves downwardly, the rod pulls the sleeve 55 downwardly but the sleeve can not move and hence ratcheting action occurs between the rod 54 and the collet fingers 56 around it. This ratcheting action changes the relative location of the sleeve 55. Thus, the sleeve 55 does not move but locks around the actuator rod. If the rod 54 moves downwardly by any distance whatsoever, the sleeve 55 moves relatively upwardly by the same measure. After movement, the members 54 and 55 are in an armed condition and the nitrogen pressure inside the tool is the same as the exterior pressure (8,000 psi). That is, the piston 63 has traveled downwardly by some distance (assume 2" as an example) and the sleeve 55 has moved relatively upwardly on the actuator rod 54 by the same distance. At this point, the tool is now armed.

Before this, the means 20 could not be fired because it was not armed.

Assumed that this pressure is held on the exterior of the tool for several minutes. Whatever the interval, this assures that arming does occur because the pressure necessary to arm the tool has been accomplished. After arming, well pressure is then relieved. Flow through the tubing string 14 drops pressure below the packer 13. Assume as an example that the pressure drops rapidly to the hydrostatic pressure maintained between the plug 12 and the packer 13. Assume that this is 5000 psi, the pressure used in the example above.

There will be a 3,000 psi (8,000−5,000=3,000 psi) pressure differential located across the device 20. This pressure imbalance acts on both the piston 63 and piston 84. However, the piston 84 is retrained from moving by the locking action of the expandable C-ring 88. The pressure imbalance acting on the piston 63 creates a net upward force to drive it forcefully upward.

The piston 63 drives the actuator rod 54 upwardly. The rod 54 has been lengthened because the ratchet action moves the sleeve 55 upwardly. The upward movement of the piston 63, the piston 50 is struck and forced upwardly. To move upwardly, the shear pin 53 must be sheared. When the piston 50 is forced upwardly, it moves the locking sleeve 48 around the enlargement 44 upwardly against the coil spring 49. This releases the collets 45 around the firing pin. The firing pin is then free to move upwardly. The firing pin 34 is forced upwardly by the hydrostatic pressure with a force sufficient to cause the pin 34 to strike the primer 28. The primer is then detonated and ignites the primer cord 23. The primer cord 23 detonates, igniting the many shaped charges to assure that the TCP gun assembly 15 properly operates. Thereafter, the fired gun assembly can be safely retrieved.

The structure shown in FIGS. 2*a* through 2*d* is easily rearmed. Thus, the threaded connection is broken at 31 to enable a new primer 28 to be placed in the illustrated position and to also permit new primer cord to be located in the passage 22. That portion of the equipment is easily reassembled. The shear pin 53 is likewise replaced upon retracting the firing pin to the original and illustrated position. Likewise, the shear pin 85 is replaced. This enables the tool to be quickly disassembled and reassembled with new shear pins, primer cord and the parts positioned in the illustrated position to enable subsequent operation.

Joint Movement of Pistons 84 and 87

As an important advantage, the pistons 84 and 87 provide a locking feature operating in this fashion. The piston 84 moves upwardly to arm the tool 20. During this movement, the piston 87 is carried along and jams the rods 78 upwardly. This upward movement is accompanied by locking or latching the ring 88 on radial expansion into the groove 89. Arming is assured by the locking of the ring 88 in the groove 89. This sustains the piston 87 in the locked position against the rods 78. The rods 78 are fixed in the up position and are prevented from falling back. The locking procedure assures and sustains such locking action on the rods and hence on the components dependent on the rod operation.

In the event the piston 63 cannot exert sufficient force on the piston 50 to shear pins 53, the pins 90 will shear allowing the piston 84 to move downward and reduce nitrogen pressure inside the chamber. This action serves as a safety disarm since low pressure is now acting in piston 63.

An important factor to note is the selection of shear pin strength. The shear pins are selected for different strengths. This makes certain the firing sequence and prevents accidental firing by hydrostatic pressure at the bottom of the well. As an easy example, the shear pins can be elected to require practically any level of pressure above hydrostatic or bottom hole pressure to trigger operation. In one example, assume that bottom hole pressure is 5000 psi while the pressure required to operate the means 20 is 9000 psi. The well can be pressured up to 10,000 psi as an example. When shear pins can be selected to shear at about 9000 psi. Over pressuring adds certainty of performance. Over pressuring then assures proper operation with safety. Moreover, this is accomplished taking into account bottom hole pressure and thus makes the initiator means 20 independent of bottom hole pressure. Likewise, it is independent of annular pressure.

While the foregoing is directed to the preferred embodiment, the scope thereof is determined by the claims which follow.

What is claimed is:

1. A method of perforating a well below a packer comprising the steps of:

(a) positioning a perforating gun assembly on a tubing string at a specified depth in a well below a packer;

(b) selecting a pressure in excess of bottom hole pressure at which a perforating gun detonator means is operated;

(c) increasing the pressure below the packer by pumping a fluid through the tubing into the volume below said packer at least to that pressure required for perforating gun detonator means operation;

(d) firing the perforating gun detonator means by arming the perforating gun detonator means by exceeding the pressure required to move a piston in a cylinder within said perforating gun detonator means to an armed position; and (e) locking the piston in the cylinder after movement to the armed position.

2. The method of claim 1 wherein said perforating gun detonator means is an armed by first applying a pressure above a specified level to said perforating gun detonator means, and said perforating gun detonator means is fired by applying a reduced pressure below a specified level and including the step of raising the pressure below the packer means to at least that pressure required for arming said perforating gun detonator means and subsequently reducing the pressure below the packer means to less than that required for firing of the perforating gun detonator means.

3. The method of claim 1 wherein the perforating gun detonator means is positioned below the perforating gun assembly which is below the packer means.

4. The method of claim 1 wherein pressure is selected in excess of hydrostatic pressure by installing shear pins which are sheared upon applying a specified force thereto, the shear pins forbidding operation of the perforating gun detonator means until an operating pressure in excess of specified pressure is achieved.

5. The method of claim 1 wherein the step of operating the perforating gun detonator means requires raising the pressure below the packer to at least a specified level for a specified interval, and thereafter relieving that pressure to drop below a specified pressure level.

6. The method of claim 1 wherein said perforating gun detonator means includes a primer separated from a firing pin for striking the primer and including the step of locking the firing pin from the primer before the perforator gun detonator means is placed in the well, and conditionally releasing the firing pin when the perforating gun detonator means is exposed to a pressure above that pressure required for operation thereof.

7. The method of claim 6 including the step of arming the perforating gun detonator means by exposure to pressure above a specified level, and including the subsequent step of firing the primer by movement of the firing pin into the primer accomplished on dropping the pressure at the perforating gun detonator means.

8. The method of claim 1 including within said perforating gun detonator means comprises;

(a) a piston in a cylinder;
(b) shear pin means immovably securing said piston;
(c) firing pin;
(d) primer means spaced from said firing pin;
(e) means locking said firing pin in a fixed location;

and wherein the method includes the steps of:

(f) applying pressure through the tubing string to said piston to move said piston in said cylinder;
(g) increasing the pressure until said shear pin means releases said piston;
(h) moving said piston after release by said shear pin means;
(i) arming said firing pin by movement of said piston overcoming said firing pin locking means;
(j) moving said firing pin into said primer for detonation after arming said firing pin.

9. The method of claim 8 including the step of moving said firing pin by moving said piston and thereafter moving said locking means to overcome locking thereof.

10. For use in detonating shaped charges in a tubing conveyed perforating gun assembly supported on a tubing string, an apparatus comprising pressure operated shaped charge detonating means, means connecting said pressure operated means at the lower end of a tubing conveyed perforating gun assembly, and means locking said pressured operated shaped charge detonating means in an armed condition only after a selected pressure sequence is applied to said pressure operated shaped charge detonating means.

11. The apparatus of claim 10 including high pressure in excess of a selected high pressure to lock said pressure operated shaped charge detonating means in an armed position after the high pressure has been exceeded.

12. The apparatus of claim 11 including a supportive sealing packer above the tubing conveyed perforating gun assembly sealing the well volume therebelow, and further including pressure flow means cooperative with the tubing string to controllably raise the pressure below said packer.

13. The apparatus of claim 12 including:

(a) means holding a primer cord extending to shaped charges in the assembly;
(b) primer means positioned to detonate the primer cord;
(c) a firing pin remote from said primer means;
(d) pressure sequence operated means for arming said firing pin; and
(e) said pressure sequence operated means further causing said firing pin to strike said primer means after arming.

14. The apparatus of claim 13 further including shear pin means limiting movement of said firing pin.

15. For use in detonating shaped charges in a tubing conveyed perforating gun assembly supported on a tubing string, an apparatus comprising;

(a) an elongate body;
(b) pressure responsive means in said body said means having a first position in said body and movable to a second position;
(c) primer means positioned operatively relative to a primer cord to detonate shaped charges in the assembly;
(d) normally disarmed firing means for firing said primer means;
(e) means operated by said pressure responsive means for arming said normally disarmed firing means;
(f) adjustable means setting said pressure responsive means to selected pressure to enable said pressure responsive means to operate thereby firing said firing means and causing said primer means to detonate shaped charges through said primer cord; and
(g) lock means for securing said firing means in the armed condition after arming.

16. The apparatus of claim 15 wherein said pressure responsive means comprises:

(a) first piston and cylinder means in said elongate body operable by pressure exterior of said body;
(b) second piston and cylinder means in said elongate body operable by said first piston and cylinder means to move to an arming position;
(c) means connected to said second piston and cylinder means for positively forming an arming position from said second piston and cylinder means to normally disarmed firing means prior to firing thereby; and
(d) said firing means firing only after the arming position has been formed.

17. The apparatus of claim 16 including port means introducing exterior pressure to move said first piston; and passage means between said first and second piston and cylinder means for a ratably conducting pressure fluid therebetween.

18. The apparatus of claim 17 including shear pin mounted means protecting said firing means from firing.

19. The apparatus of claim 18 including an elongate firing pin received in an elongate passage means for movement therealong to detonate said primer means.

20. For use in detonating shaped charges in a tubing conveyed perforating gun assembly supported on a tubing string, an apparatus comprising pressure operated shaped charge detonating means, and means connecting said pressure operated means at the lower end of a tubing conveyed perforating gun assembly; and including a supportive sealing packer above the tubing conveyed perforating gun assembly sealing the well volume therebelow, and further including pressure flow means cooperative with the tubing string to controllably raise the pressure below said packer, and further including:

means holding a primer cord extending to shaped charges in the assembly;
primer means positioned to detonate the primer cord;
a firing pin remote from said primer means;
pressure sequence operated means for arming said firing pin; and
said pressure sequence operated means further causing said firing pin to strike said primer means after arming.

21. The apparatus of claim 20 including shear pin means limiting movement of said firing pin.

22. For use in detonating shaped charges in a tubing conveyed perforating gun assembly supported on a tubing string, an apparatus comprising;

(a) an elongate body;

(b) pressure responsive means in said body said means having a first position in said body and movable to a second position;

(c) primer means positioned operatively relative to a primer cord to detonate shaped charges in the assembly;

(d) normally disarmed firing means for firing said primer means;

(e) means operated by said pressure responsive means for arming said normally disarmed firing means; and (f) adjustable means setting said pressure responsive means to selected pressures to enable said pressure responsive means to operate thereby firing said firing means and causing said primer means to detonate shaped charges through said primer cord.

* * * * *